US006322193B1

(12) United States Patent
Lian et al.

(10) Patent No.: US 6,322,193 B1
(45) Date of Patent: Nov. 27, 2001

(54) METHOD AND APPARATUS FOR MEASURING THE DROPLET FREQUENCY RESPONSE OF AN INK JET PRINTHEAD

(75) Inventors: Zhi-Ru Lian, Tainan Hsien; Ming-Ling Lee, Hsinchu; Yi-Hsuan Lai, Hsinchu; Hung-Lieh Hu, Hsinchu; Chieh-Wen Wang, Hsinchu, all of (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/235,260

(22) Filed: Jan. 22, 1999

(30) Foreign Application Priority Data

Oct. 23, 1998 (TW) ..... 87117559

(51) Int. Cl.[7] ..... B41J 29/393

(52) U.S. Cl. ..... 347/19

(58) Field of Search ..... 347/19, 53, 54, 347/55, 14, 23, 47, 56, 61, 44, 80, 81, 71, 6, 7, 15; 324/76.12, 76.19; 361/139; 346/140 R, 1.1

(56) References Cited

U.S. PATENT DOCUMENTS 4,484,199 * 11/1984 Watanabe ..... 347/80

* cited by examiner

*Primary Examiner*—John Barlow
*Assistant Examiner*—Charles W. Stewart, Jr.
(74) *Attorney, Agent, or Firm*—Jiawei Huang; J. C. Patents

(57) ABSTRACT

A magnetoelectric apparatus for measuring the droplet frequency response at a printhead by applying a method comprising a metallic detecting plate and a magnetic ring, and a method using the foregoing apparatus to determine the maximum droplet frequency response of the printhead. When an ink drop jetted from the nozzle makes contact with the detecting plate, which is perpendicular to the nozzle plate of the printhead, a current flows through the detecting plate immediately, and is detected as a portion of an expected signal. As soon as the ink drop leaves the nozzle completely, the foregoing current no longer exists. However, the magnetic ring generates an induced current that flows in the same direction as that of the foregoing current to complement the absence thereof, wherein the induced current is also detected as another portion of the expected signal. The expected signal is then processed by a signal-processing routine for determining the maximum droplet frequency response of the inkjet printhead.

20 Claims, 6 Drawing Sheets

METHOD AND APPARATUS FOR MEASURING THE DROPLET FREQUENCY RESPONSE OF AN INK JET PRINTHEAD

CROSS-REFERENCE TO RELATED APPLICATION

This application claims the priority benefit of Taiwan application serial no. 87117559, filed Oct. 23, 1998, the full disclosure of which is incorporated herein by reference.

BACKGROUND OF THE INVENTION

1. Field of the Invention

This invention relates to a method and an apparatus for measuring the frequency response of, and more particularly, to a magnetoelectric method and apparatus for measuring the droplet frequency response of an ink jet printhead.

2. Description of Related Art

For most commercial inkjet printers, printing graphics and documents is normally carried out by the printhead. In principle, a printhead of an inkjet printer heats up the ink and vaporizes the ink to form ink bubbles by converting electric energy into heat. The printhead then jets the ink drops, which are developed from the ink bubbles, onto a destination surface through spouts. In order to speed up the printing efficiency of an inkjet printer, the manufacturers normally focus on increasing the droplet frequency response. That is, the droplet frequency response indicates the printing speed of an inkjet printer. Hence, how to measure the droplet frequency response of an inkjet printhead has become a very important technique in inkjet printer manufacture.

The droplet frequency response is obtained by comparing the detected actual jetting frequency of an inkjet printhead with the driving frequency actually applied to the inkjet printhead. The maximum droplet frequency response of the inkjet printhead can be measured by checking the matching between different driving frequencies applied on the inkjet printhead and the actual responding jetting frequencies of the inkjet printhead. Since the ink bubbles are generated at the printhead in a frequency varied from several kilo-Hertz (kHz) to several tens kHz, it is impossible to detect the actual droplet frequency response through a regular image mapping system. Even though utilizing a high-speed camera it is possible to catch the actual droplet frequency response of an inkjet printhead, and determine the droplet frequency response of the inkjet printhead, it is not cost effective. Hence, some apparatuses and methods have been developed for the purpose of measuring droplet frequency response of an inkjet printhead, such as those disclosed by U.S. Pat. Nos. 4,484,199 and 4,590,482.

The schematic cross-sectional diagram of a conventional measuring apparatus for determining the droplet frequency response is illustrated in FIG. 1.

Referring to FIG. 1, a planar detecting electrode 106 is placed parallel to a metallic nozzle plate 100, and a voltage difference exists between the detecting electrode 106 and the nozzle plate 100. The detecting electrode 106 and the nozzle plate 100 are not electrically connected, though the distance between them is quite short, for example less than 100 $\mu$m. Once an ink drop 104 is jetted by the nozzle plate 100 through nozzle 102, the ink drop forms an electric connection between the detecting electrode 106 and the nozzle plate 100 before the ink drop 14 totally leaves the nozzle plate 100. The electric connections formed by continuously jetted ink drops out of the nozzle plate 100 can be detected by an attached electronic circuit (not shown in figure) for obtaining the forming frequency of the ink drops. However, ink drops are easily stuck within the narrow space between the detecting electrode 106 and the nozzle plate 100, and that leads to an error reading on the forming frequency of ink drops while a detecting process is performed.

The schematic cross-sectional diagram of another conventional measuring apparatus for determining the droplet frequency response is illustrated in FIG. 2.

Referring to FIG. 2, a pair of electrodes 208 is placed between the nozzle plate 200 and the detecting electrode 206, wherein a high voltage is applied on the electrodes 208 to provide a high-voltage electric field. While an ink drop 204 jetted by the nozzle plate 100 passes through the electrodes 208, the ink drop is charged. An electric signal can then be detected at the detecting electrode 206 after the charged ink drop hits the detecting electrode 206. By counting the number of the electric signals within a period of time, the forming frequency of the ink drops is obtained. An ink drop, which is about 100 pico liters (pl) in volume, is possibly broken into several sub-drops while the ink drop 204 passes through the high-voltage electric field says, exceeding 1000 volts. Therefore, the detected forming frequency at the detecting electrode is interfered by the noise signals given by the sub-drops.

SUMMARY OF THE INVENTION

It is therefore an objective of the present invention to provide a method and apparatus that ensures a more precise measurement of the droplet frequency response which is not interfered with by the noise signal and error reading.

In accordance with the foregoing objective of the present invention, the magnetoelectric apparatus of the invention for measuring the forming frequency of ink drops at a printhead contains a metallic detecting plate and a magnetic ring. The method of the invention then determines the maximum droplet frequency response of the printhead by comparing the forming frequencies and the corresponding driving frequencies. When an ink drop jetted from the nozzle makes a contact with the detecting plate, which is perpendicular to the nozzle plate of the printhead, a current flows through the detecting plate immediately, and detected as a portion of the expected signal. As soon as the ink drop leaves the nozzle completely, the foregoing current no longer exists. However, the magnetic ring generates an induced current that flows in the same direction as that of the foregoing current to complement the absence thereof, wherein the induced current is also detected as another portion of the expected signal. The expected signal is then processed by a signal-processing routine for determining the maximum droplet frequency response of the inkjet printhead.

BRIEF DESCRIPTION OF DRAWINGS

The invention can be more fully understood by reading the following detailed description of the preferred embodiments, with reference made to the accompanying drawings, wherein.

DETAILED DESCRIPTION OF PREFERRED EMBODIMENTS

The invention provides a new method and apparatus for measuring the droplet frequency response. The measuring apparatus of the invention is shown in FIGS. 3A, 3B and 4 from different viewpoints.

Figure 1:
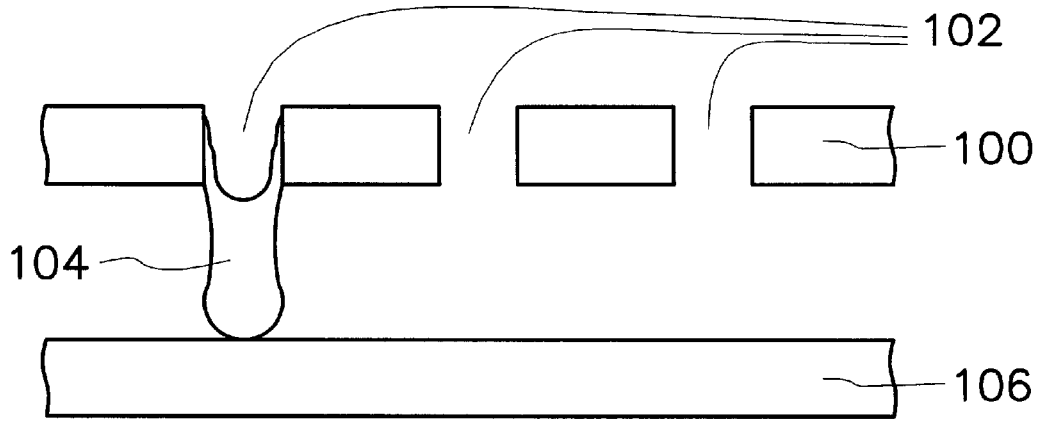
FIG. 1 (PRIOR ART)
FIG. 1 is a schematic side-viewed diagram showing a conventional measuring apparatus for detecting the forming frequency of ink drops.
Figure 2:
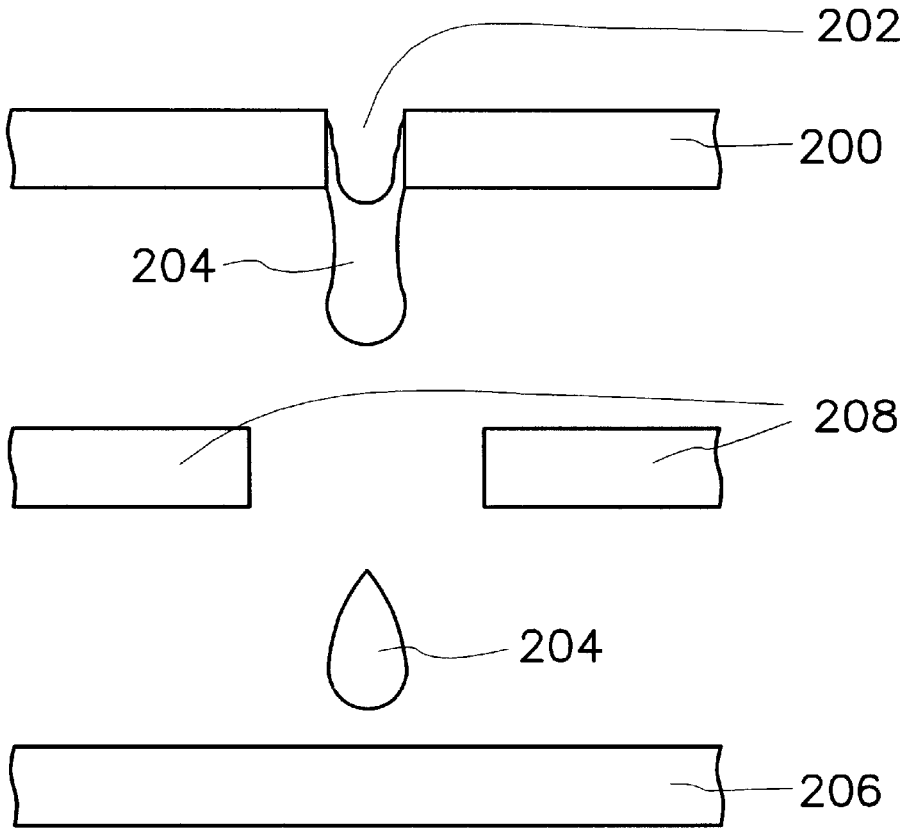
FIG. 2 (PRIOR ART)
FIG. 2 is a schematic side-viewed diagram showing another conventional measuring apparatus for detecting the forming frequency of ink drops.
Figure 3A:
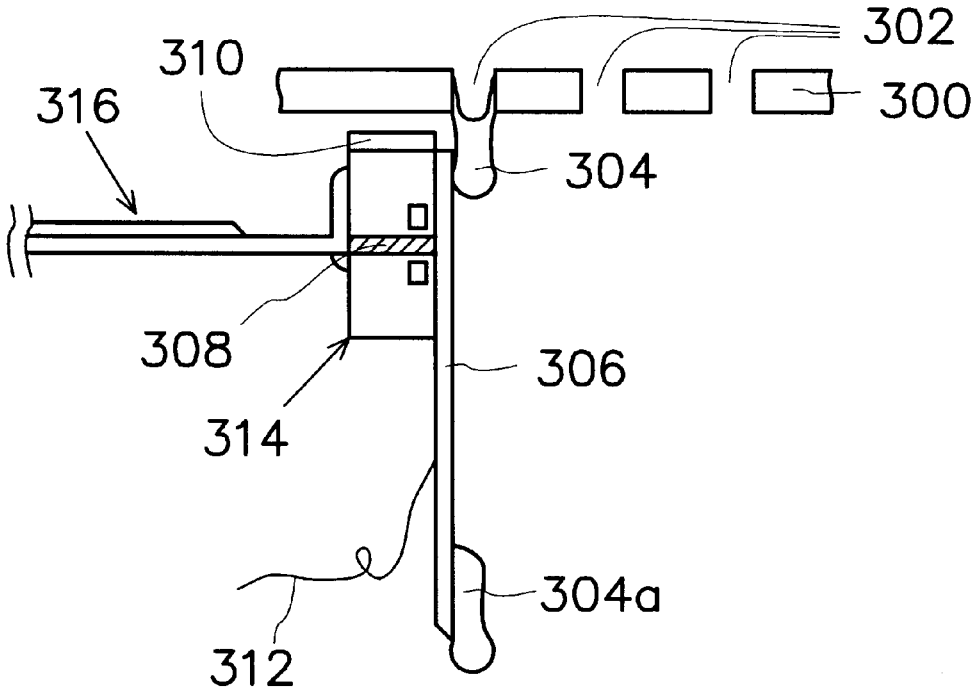
FIG. 3A and FIG. 3B are schematic diagrams showing a measuring apparatus for detecting the forming frequency of ink drops used in a preferred embodiment according to the invention.
Figure 3B:
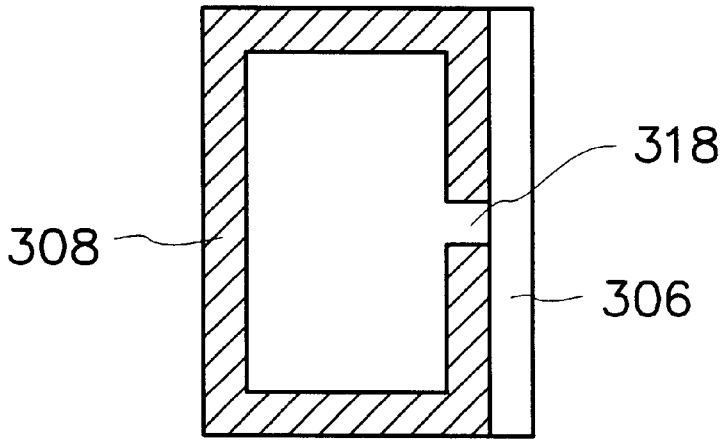

Referring to FIG. 3A together with FIG. 3B, a side view of the measuring apparatus of the invention, the measuring apparatus contains a metallic detecting plate 306 and a magnetic ring 308 both placed under the nozzle plate 300. The detecting plate 306 is perpendicular to the nozzle plate 300. In order to prevent an erroneous reading caused by stuck ink drops gathering on the detecting plate 306, the lower section of the detecting plate 306 is designed to be capable of draining ink drops efficiently. Since the ink drops are formed at a pretty high forming frequency, from several kHz to several tens kHz, an erroneous reading is possibly obtained if the measured ink drops can not be efficiently drained. According to the foregoing consideration, the lower section of the detecting plate 306, for example, is made to be a metallic net-like structure, or a plate with a sharp corner pointing downward as shown in FIG. 4. With a net-like structure or a sharp-corner shape, ink drops 304 dropped on the detecting plate 306 tend toward getting together as a larger drop 304*a,* which is easily drained from the detecting plate 306.

Referring next to FIG. 3B, the magnetic ring 308 has an opening 318 toward the detecting plate 306, wherein the magnetic ring 308 is attached to the detecting plate 306 with the side arms aside the opening 318. The plane circled by the magnetic ring 308 is perpendicular to the detecting plate 306, and parallel to the ground. The magnetic ring 308 is, for example, an about 0.3-mm-thick lamination consisting of high-permeability material films or high-permeability alloy films. The selected high-permeability alloy can be an alloy of about 78% nickel and about 22% iron or other alloys with the similar properties. The selected high-permeability material can be ferrite, sand dust, or other material with the similar properties. The air gap of the magnetic ring is about 100 to 150 $\mu$m.

Figure 4:
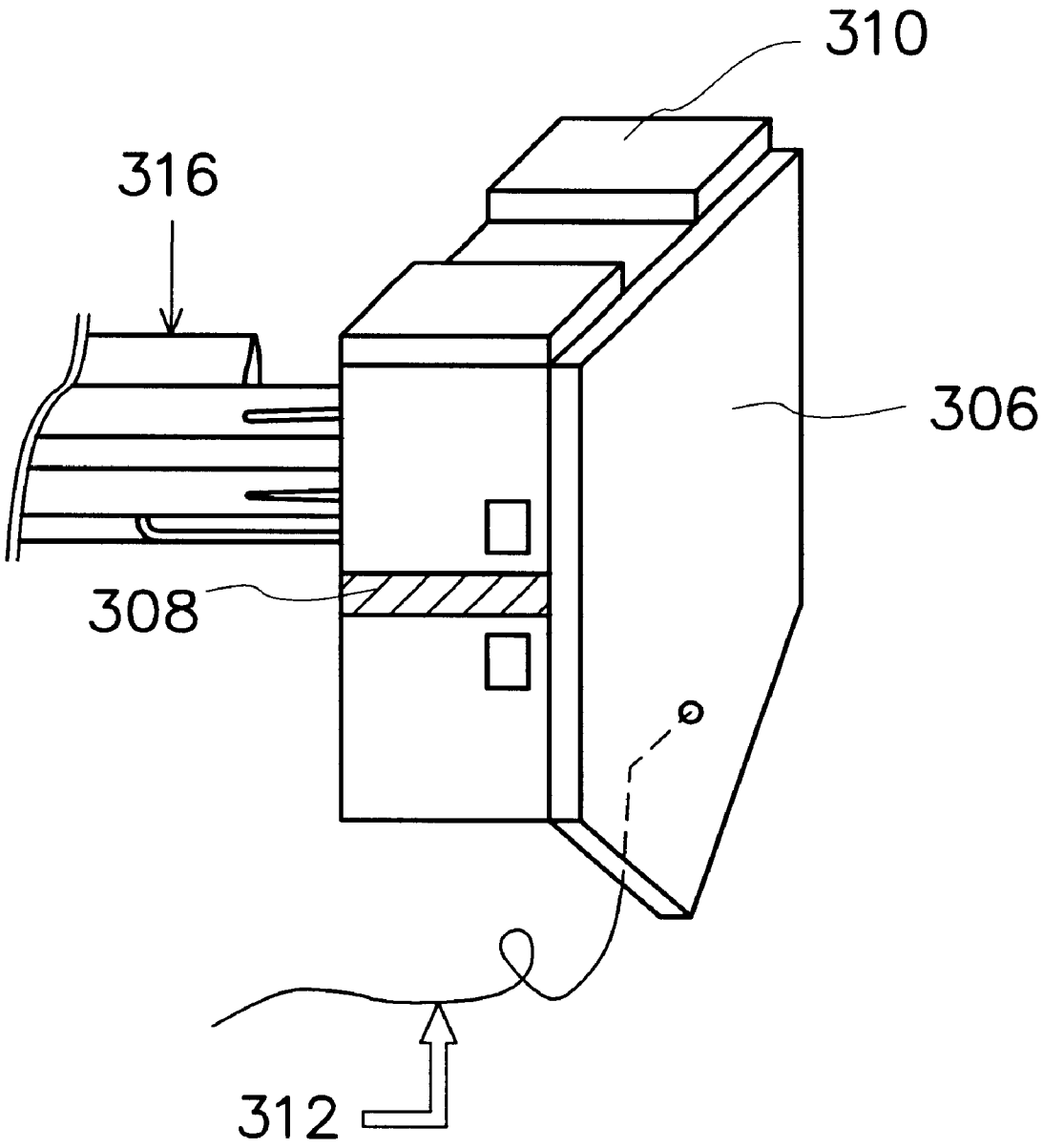
FIG. 4 is a schematic top-viewed diagram showing a measuring apparatus for detecting the forming frequency of ink drops used in the preferred embodiment according to the invention.

Referring to FIG. 4 together with FIG. 3A, an insulating layer 310 is placed between the nozzle plate 300 and the detecting plate 306 to prevent unnecessary electric connection between the nozzle plate 300 and the detecting plate 306. The insulating layer 310 is about 10 to 100 $\mu$m in thickness. While a detecting task is performed, the measuring apparatus consisting of the insulating layer 310, the magnetic ring 308 and the detecting plate 306 is moving along the nozzle plate 300. The insulating layer 310 is also used here to ensure the distance between the detecting plate 306 and the nozzle plate 300 is fixed to a pre-determined distance, about the thickness of the insulating layer 310. The distance between the nozzle plate 300 and the detecting plate 306 has to be short enough, so that an ink drop 304 jetted from the nozzle 302 can still make an electric connection between those two plates before it drop off from the nozzle plate 300. All detected electric signals are output through a signal wire 312, which is electrically connected to the detecting plate 306, to a signal processor (not shown in figure).

The measuring apparatus also contains a holding apparatus 314, as shown in FIG. 3A, and a supporting arm 316, as shown in FIG. 4. The holding apparatus 314 is used to hold the magnetic ring 308, and the supporting arm 316 is used to support and move the entire measuring apparatus.

The method for measuring the droplet frequency response by utilizing the foregoing measuring apparatus of the invention is based on the magnetoelectric principle. As shown in FIG. 3A, once a detecting task is started, a voltage is applied to nozzle plate 300 through a probe (not shown in figure). The voltage is about 30 volts and is capable of providing a current that is no higher than 100 mA while a close loop is formed. When an ink drop 304 is jetted from the nozzle 302, before the ink drop 304 totally drops off from the nozzle 302, it forms an electric connection between the nozzle plate 300 and the detecting plate 306. As a result, a current I then flows through the detecting plate 306.

According to the Lenz's law, an induced magnetic field, which relates to the variation of current, is then generated by the formation of current I flowing through the detecting plate 306. Since the direction of current I is parallel to the detecting plate 306, the magnetic lines of force of the induced magnetic field generated by the show-up of the current I are perpendicular to the detecting plate 306. Therefore, the magnetic ring 308 has to be placed in the position that the area circled thereby is perpendicular to the detecting plate 306 in order to sense the induced magnetic field.

As soon as the ink drop 304 totally drops off from the nozzle 302, an induced current I' flowing in the same direction as the current I does is generated by the magnetic ring accordingly to the Lenz's law. Through the signal wire 312, the variation of voltage and current over the detecting plate 306 within a time frame is fed to a signal processing routine (not shown in figure) to be further processed.

Figure 5:
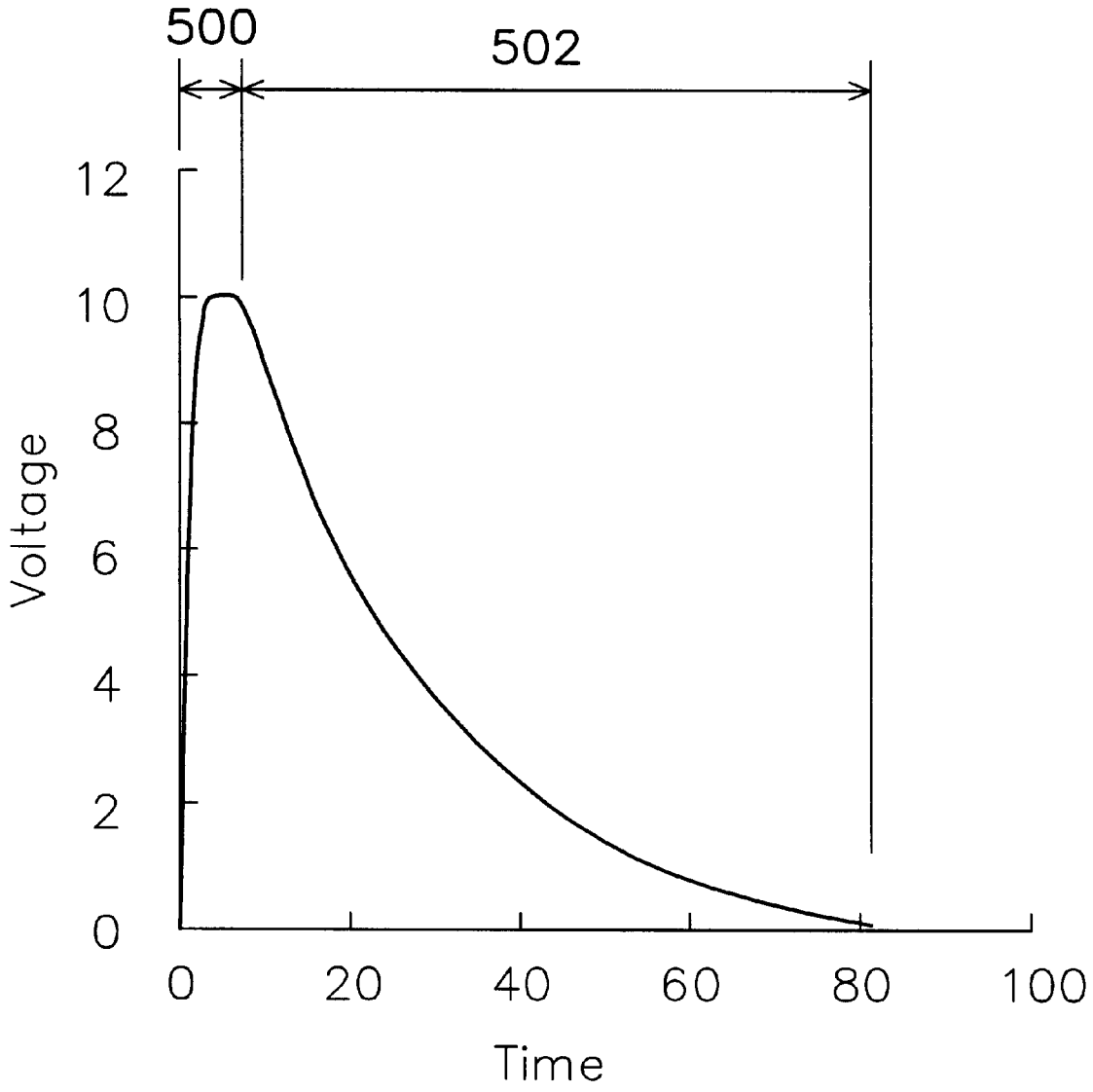
FIG. 5 is a waveform plot showing a signal detected by the measuring apparatus for detecting the forming frequency of ink drops shown in FIGS. 3 and 4.

The waveform of a detected electric signal is illustrated in FIG. 5.

Referring to FIG. 5, the x-axis represents time and the y-axis represents the voltage of the detected electric signal at a corresponding time. The detected electric signal includes two segments, a fore-signal happening within the time frame 500 and a post-signal happening within the time frame 502, wherein the fore-signal corresponds to the closed-loop current I, and the post-signal corresponds to the induced current I'. The time frame 500 starts at when the ink drop 304 jetted by the nozzle 302 begins to make contact with the detecting plate 306, wherein a portion of the ink drop 304, contacting interface, is connected to the detecting plate 306 while a contact is made. The area of the contacting interface is increased within the time frame 500, and reaches its maximum at the end of the time frame 500, that is, the ink drop 304 has dropped off completely from the nozzle 302. The post-signal detected within the time frame 502 is the induced current I' generated by the magnetic ring 308 due to the variation of current on the detecting plate 306. The induced current I' flows in the same direction as the closed loop current I does, and gradually decreases as time goes by.

Without the presence of the magnetic ring 308, the only signal detected is the narrow and sharp pulse as shown in the time frame 500 of FIG. 5 that is difficult to detect. Therefore, the measuring apparatus of the invention increases the sensitivity of the measuring apparatus by adding a magnetic ring. While the printhead is operating by applying a driving signal, every ink drop jetted from the nozzle 302 gives an electric signal detected by the magnetoelectric measuring apparatus of the invention as shown in FIG. 5.

Figure 6:
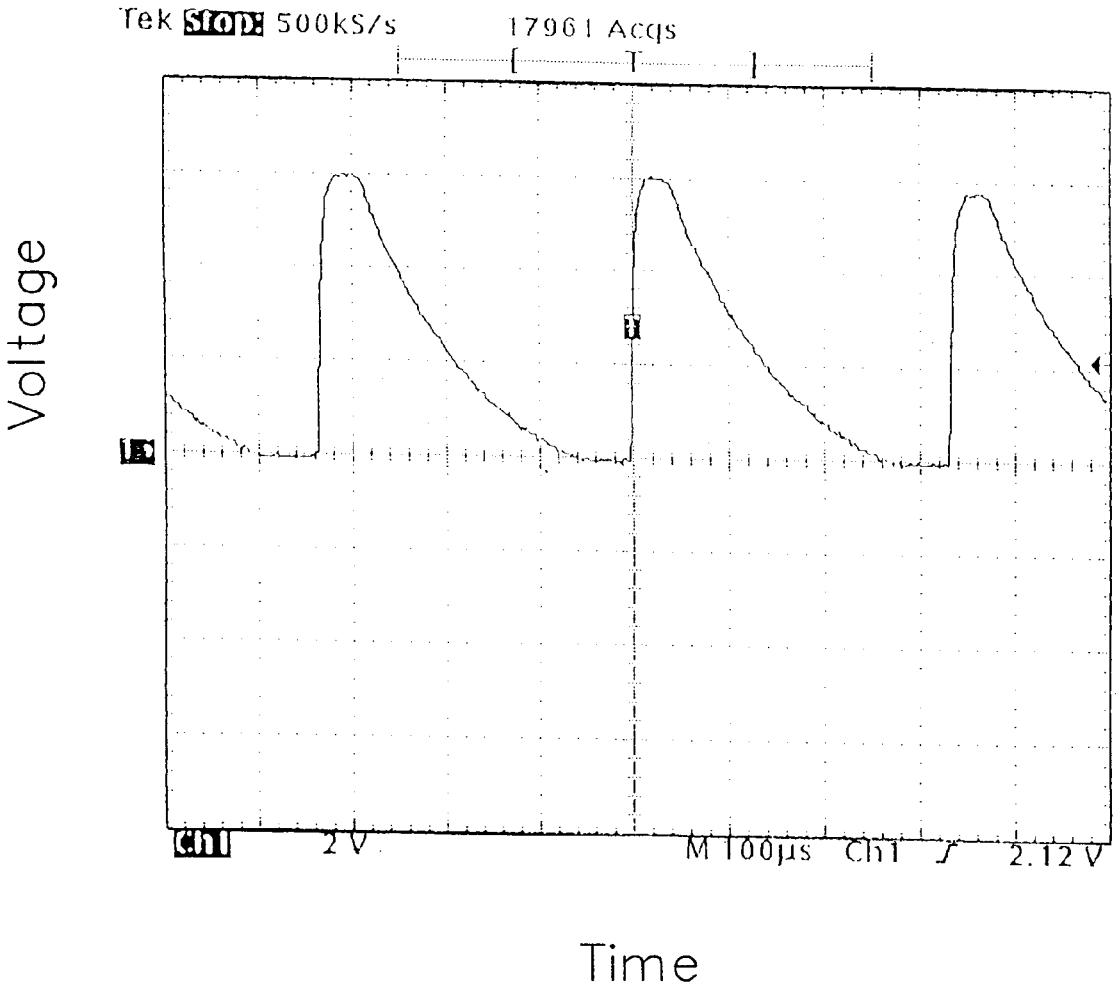
FIG. 6 is a waveform plot showing the actual signal detected by the measuring apparatus for detecting the forming frequency of ink drops shown in FIGS. 3 and 4.

Referring to FIG. 6, a waveform plot showing the electric signals detected by the measuring apparatus of the invention within a period of time is illustrated, wherein the x-axis represents time and the y-axis represents the voltage. The waveform signal in FIG. 6 can be further processed to obtain a number indicating the forming frequency of ink drops at the nozzle plate. By checking the degrees of match between the forming frequencies of ink drops and the corresponding driving frequencies, the maximum droplet frequency response of the printhead of an inkjet printer is obtained.

Figure 7:
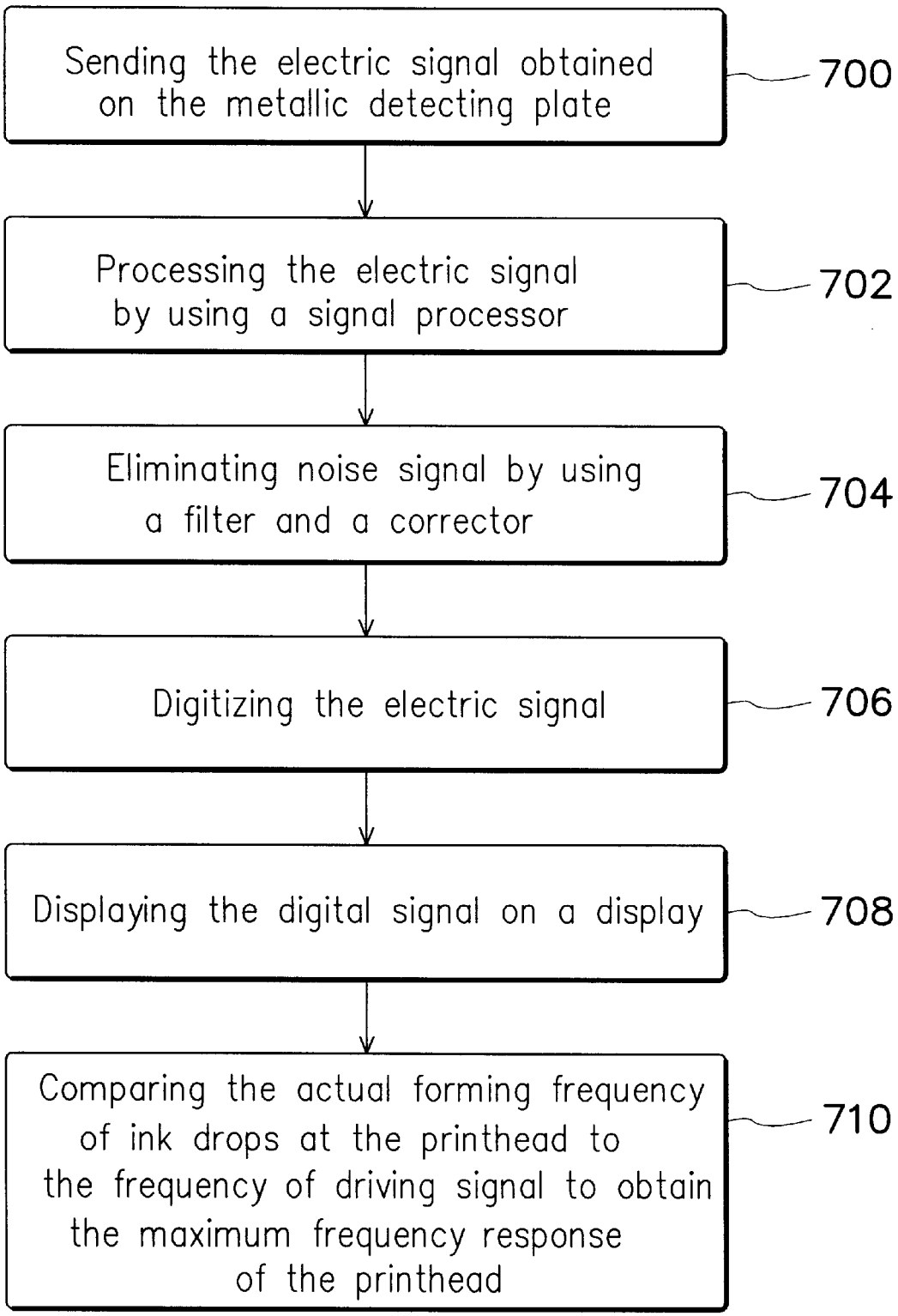
FIG. 7 is schematic block diagram showing the flowchart of signal-processing routine used to process the signals detected by the measuring apparatus of the invention shown in FIGS. 3 and 4.

The electric signals obtained on the detecting plate are sent to a signal-processing routine, and processed in a manner as shown in FIG. 7.

Referring to FIG. 7, After the electric signals are fed into the signal-processing routine through signal wire, Block 700, a signal processor then picks up the valid signals first, as shown in Block 702. The valid signals are next further adjusted and cleared by using a filter and a corrector to eliminate the noise signal as shown in Block 704. The results of Block 704 are digitized into digital signals in the follow-up step, Block 706. By using a display, such as a monitor, the digital signals are displayed on the monitor in the format of a waveform, as described in Block 708. Then, by checking the matching degrees of pairs of waveforms, each pair of waveforms consists of the forming frequency of ink drops at the printhead and the corresponding driving frequency, the maximum droplet frequency response of the inkjet printhead is obtained in Block 710.

The insulating layer of the measuring apparatus of the invention prevent undesired connection between the detecting plate and the nozzle plate, so the erroneous reading caused by improper connection is avoided. The detecting plate perpendicular to the nozzle plate is capable of draining the dropped ink drops efficiently, so that no ink drop is stuck between the detecting plate and the nozzle plate that affect the detected results.

The magnetic ring of the measuring apparatus of the invention further enhances the detected signals, so the detected results are more easily to be processed for obtaining more precise results.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A apparatus for measuring a droplet frequency response of a printhead, wherein the printhead comprises a nozzle plate, and wherein the apparatus for measuring the droplet frequency response is placed under the nozzle plate, and wherein the nozzle plate comprises at least a nozzle, the apparatus comprising:

a metallic detecting plate, placed under the nozzle plate, wherein the metallic detecting plate has a first surface and a second surface;

an insulating layer, placed between the metallic detecting plate and the nozzle plate;

a magnetic ring, connected to first surface of the metallic detecting plate, wherein a plane circled by the magnetic ring is perpendicular to the first surface of the metallic detecting plate; and a signal wire electrically connected to a lower portion of the first surface of the metallic detecting plate.

2. The apparatus for measuring the droplet frequency response of claim 1, wherein the metallic detecting plate includes a metallic net-like structure.

3. The apparatus for measuring the droplet frequency response of claim 1, wherein the lower portion of the metallic detecting plate includes a sharp corner.

4. The apparatus for measuring the droplet frequency response of claim 1, wherein the insulating layer is about 10 to 100 $\mu$m in thickness.

5. The apparatus for measuring the droplet frequency response of claim 1, wherein the magnetic ring has an opening.

6. The apparatus for measuring the droplet frequency response of claim 5, wherein the magnetic ring is attached to the first surface of the metallic detecting plate by two portions of the magnetic ring aside either sides of the opening.

7. The apparatus for measuring the droplet frequency response of claim 1, wherein the magnetic ring is made of a high-permeability alloy.

8. The apparatus for measuring the droplet frequency response of claim 7, wherein the magnetic ring is made of a high-permeability alloy consisting of about 78% nickel and about 22% iron.

9. The apparatus for measuring the droplet frequency response of claim 1, wherein the magnetic ring is made of ferrite.

10. The apparatus for measuring the droplet frequency response of claim 1, wherein the magnetic ring is made of sand dust.

11. The apparatus for measuring the droplet frequency response of claim 1, wherein the signal wire sends signals obtained by the metallic detecting plate toward a signal-processing routine consisting of a plurality of processors.

12. The apparatus for measuring the droplet frequency response of claim 11, wherein the processors at least include a signal processor, a filter, a corrector, and a display.

13. A method for measuring a droplet frequency response of an inkjet printhead by using a first apparatus and a second apparatus, wherein the first apparatus comprises a magnetic apparatus, and wherein the printhead comprises a nozzle plate, and wherein the printhead is driven by a driving signal, the method comprising steps of:

applying a voltage on the nozzle plate;

obtaining a first current signal within a first time frame starting from when an ink drop jetted from the nozzle plate first makes a contact with the first apparatus to form a closed loop, and ending at when the ink drop totally leaves the nozzle plate to break the closed loop wherein the first current signal is sent to the second apparatus;

obtaining a second current signal within a second time frame starting from when the ink drop totally leaves the nozzle plate, and ending at when the ink drop is drained from the first apparatus, wherein the second current signal is an induced current generated by the magnetic apparatus of the first apparatus, and wherein the second current signal is sent to the second apparatus; and using the second apparatus to determine the droplet frequency response of the printhead by processing the first current signal and the second current signal.

14. The method of claim 13, wherein the first apparatus comprises a metallic detecting plate, a magnetic ring and a signal wire.

15. The method of claim 14, wherein the induced current is generated by the magnetic ring.

16. The method of claim 14, wherein the induced current is generated on the metallic plate.

17. The method of claim 14, wherein the first current signal and the second current signal are sent to the second apparatus through the signal wire.

18. The method of claim 13, wherein the second apparatus comprises a signal processor, a filter, a corrector and a display.

19. The method of claim 13, wherein the method further comprises comparing an actual forming frequency of ink drops at the printhead with a frequency of the driving signal.

20. A method for measuring a droplet frequency response of an inkjet printhead by using a first apparatus and a second apparatus, wherein the printhead comprises a nozzle plate, and wherein the printhead is driven by a driving signal, the method comprising steps of:

applying a voltage on the nozzle plate;

obtaining a current signal within a first time frame starting from when an ink drop jetted from the nozzle plate first makes a contact with the first apparatus to form a closed loop, and ending at when the ink drop totally leaves the nozzle plate to break the closed loop wherein the current signal is sent to the second apparatus; and using the second apparatus to determine the droplet frequency response of the printhead by processing the current signal.

* * * * *